US010538850B2

(12) United States Patent
Brunner et al.

(10) Patent No.: US 10,538,850 B2
(45) Date of Patent: Jan. 21, 2020

(54) ELECTROLYTIC COPPER PLATING BATH COMPOSITIONS AND A METHOD FOR THEIR USE

(71) Applicant: Atotech Deutschland GmbH, Berlin (DE)

(72) Inventors: Heiko Brunner, Berlin (DE); Dirk Rohde, Berlin (DE); Manuel Pölleth, Berlin (DE); Sven Rückbrod, Berlin (DE); Desthree Darwin, Berlin (DE); Sandra Niemann, Berlin (DE); Gerhard Steinberger, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 232 days.

(21) Appl. No.: 15/567,637

(22) PCT Filed: Apr. 20, 2016

(86) PCT No.: PCT/EP2016/058704

§ 371 (c)(1),
(2) Date: Oct. 19, 2017

(87) PCT Pub. No.: WO2016/169952

PCT Pub. Date: Oct. 27, 2016

(65) Prior Publication Data

US 2018/0112320 A1 Apr. 26, 2018

(30) Foreign Application Priority Data

Apr. 20, 2015 (EP) ..... 15164344

(51) Int. Cl.
*C25D 3/58* (2006.01)
*C25D 3/38* (2006.01)
(Continued)

(52) U.S. Cl.
CPC ..... *C25D 3/38* (2013.01); *C25D 7/00* (2013.01); *C25D 21/00* (2013.01)

(58) Field of Classification Search
CPC ..... C25D 3/38; C25D 3/58
(Continued)

(56) References Cited

U.S. PATENT DOCUMENTS 5,976,341 A 11/1999 Schumacher et al.
6,099,711 A 8/2000 Dahms et al.
(Continued)

FOREIGN PATENT DOCUMENTS

DE 2025538 10/1971
DE 3003978 8/1981

OTHER PUBLICATIONS

PCT/EP2016/058704; PCT International Search Report and Written Opinion of the International Searching Authority dated Sep. 2, 2016.
(Continued)

*Primary Examiner* — Edna Wong
(74) *Attorney, Agent, or Firm* — Renner, Otto, Boisselle & Sklar, LLP

(57) ABSTRACT

The present invention relates to aqueous acidic plating baths for copper and copper alloy deposition in the manufacture of printed circuit boards, IC substrates, semiconducting and glass devices for electronic applications. The plating bath according to the present invention comprises at least one source of copper ions, at least one acid and at least one guanidine compound. The plating bath is particularly useful for plating recessed structures with copper and build-up of copper pillar bump structures.

20 Claims, 2 Drawing Sheets

(51) Int. Cl.

| | |
|---|---|
| ***C23C 18/38*** | (2006.01) |
| ***C25D 7/00*** | (2006.01) |
| ***C25D 21/00*** | (2006.01) |

(58) Field of Classification Search
USPC ..... 106/1.26; 205/239, 296, 297, 241, 242
See application file for complete search history.

(56) References Cited

U.S. PATENT DOCUMENTS

| | | | | |
|---|---|---|---|---|
| 8,268,157 | B2 | 9/2012 | Niazimbetova | |
| 8,679,316 | B2 | 3/2014 | Brunner et al. | |
| 9,322,107 | B2 | 4/2016 | Brunner et al. | |
| 9,331,040 | B2 | 5/2016 | Beck et al. | |
| 9,506,158 | B2 | 11/2016 | Rohde et al. | |
| 9,551,080 | B2 | 1/2017 | Brunner et al. | |
| 2004/0187731 | A1 | 9/2004 | Wang et al. | |
| 2008/0223726 | A1 | 9/2008 | Eckles et al. | |
| 2009/0127708 | A1 | 5/2009 | Lee et al. | |
| 2012/0160698 | A1* | 6/2012 | Brunner ..... | C08G 71/02 205/244 |

OTHER PUBLICATIONS

PCT/EP2016/058704; PCT International Preliminary Report on Patentability dated Jul. 7, 2017.

* cited by examiner

ELECTROLYTIC COPPER PLATING BATH COMPOSITIONS AND A METHOD FOR THEIR USE

FIELD OF THE INVENTION

The invention relates to plating bath compositions for electro-deposition of copper or copper alloys. The plating bath compositions are suitable in the manufacture of printed circuit boards, IC substrates and the like as well as for metallization of semiconducting and glass substrates. They are particularly suitable for the formation of copper pillar bumps.

BACKGROUND OF THE INVENTION

Aqueous acidic plating baths for electrolytic deposition of copper are used for manufacturing printed circuit boards and IC substrates where fine structures like trenches, through holes (TH), blind micro vias (BMV) need to be filled with copper. Another application which is becoming more important is filling through glass vias, i.e. holes and related recessed structures in glass substrates with copper or copper alloys by electroplating. A further application of such electrolytic deposition of copper is filling of recessed structures such as through silicon vias (TSV) and dual damascene plating or forming redistribution layers (RDL) and pillar bumps in and on semiconducting substrates. For redistribution layers (RDL) and pillar bumps, a photoresist mask is used to define the microstructures to be filled with electrolytic copper. Typical dimensions for RDL patterns are 100 to 300 μm for pads and 5 to 30 μm for contact lines; copper thicknesses are usually in the range of 3 to 8 μm or in some cases up to 10 μm. Deposit thickness homogeneity within the microstructure (within profile uniformity=WIP), within the chip/die area (within die uniformity=WID) and within the wafer (within wafer uniformity=WIW) are critical criteria. Pillar bumping applications require copper layer thicknesses of about 10 to 100 μm. The pillar diameters are typically in the range of 20 to 80 or even up to 100 μm. In-die non-uniformity and within-bump non-uniformity values of less than 10% are typical specifications.

The patent application EP 1 069 211 A2 discloses aqueous acidic copper plating baths comprising a source of copper ions, an acid, a carrier additive, a brightener additive and a leveller additive which can be poly[bis(2-chloroethyl) ether-alt-1,3-bis[3-(dimethylamino)propyl]urea (CAS-No. 68555-36-2) which contains an organo-bound halide atom (e.g., covalent C—Cl bonds) in at least one terminus.

Urea polymers are known in the art from WO 2011/029781 A1 for the electrolytic deposition of zinc. Such polymers are made by a polyaddition of aminourea derivatives and nucleophiles. They are further known from EP 2 735 627 A1 as levellers for the electrolytic deposition of copper. However, the usage of such polymers as additives in copper pillar formation results in low pillar growth and an unfavorable pillar size distribution on a die (see examples, table 1). An in-homogeneous pillar size distribution may result in a lack of contact between the die and further components to which the die is assembled.

U.S. Pat. No. 8,268,157 B2 relates to copper electroplating bath compositions comprising a reaction product of diglycidylethers and nitrogen-containing compounds such as amines, amides, ureas, guanidines, aromatic cyclic nitrogen compounds such as imidazoles, pyridines, benzimidazoles, tetrazoles and so forth as levellers. Cyclic nitrogen compounds are preferred according to the teachings in this document (col. 6, l. 51), even more preferred are nitrogen containing heterocycles (col. 6, l. 53-54).

Polyethylenimines are widely used as levellers in copper electroplating baths because they are relatively convection independent. This convection independency is particularly important in copper pillar formation. A high convection dependency results in irregularly shaped pillars and an inhomogeneous pillar height distribution. However, polyethylenimines as levellers result in high amounts of organic impurities of copper deposits formed with copper electroplating baths containing these polymers (see table 2). This is undesired in semiconductor applications as this leads to reduced copper or copper alloy grain sizes with more voids which then results in reduced overall conductivity of the copper or copper alloy layers formed.

OBJECTIVE OF THE INVENTION

Thus, it is an objective of the present invention to provide an aqueous acidic copper plating bath for electrolytic deposition of copper or copper alloys which fulfils the requirements for the above mentioned applications in the field of printed circuit board and IC substrate manufacturing as well as metallization of semiconducting substrates like TSV filling, dual damascene plating, deposition of redistribution layers or pillar bumping and filling of through glass vias.

SUMMARY OF THE INVENTION

This objective is solved by using an aqueous acidic copper plating bath comprising a source of copper ions, an acid and at least one guanidine compound.

Recessed structures such as trenches, blind micro vias (BMVs'), through silicon vias (TSVs') and through glass vias can be plated with copper deposited from the aqueous acidic copper plating bath according to the present invention. The copper filled recessed structures are void-free and have an acceptable dimple, i.e., a planar or an almost planar surface. Furthermore, the fast build-up of pillar bump structures and redistribution layers is feasible and results in homogeneous size distribution of the individual pillars within a die.

DETAILED DESCRIPTION OF THE INVENTION

Figure 1:
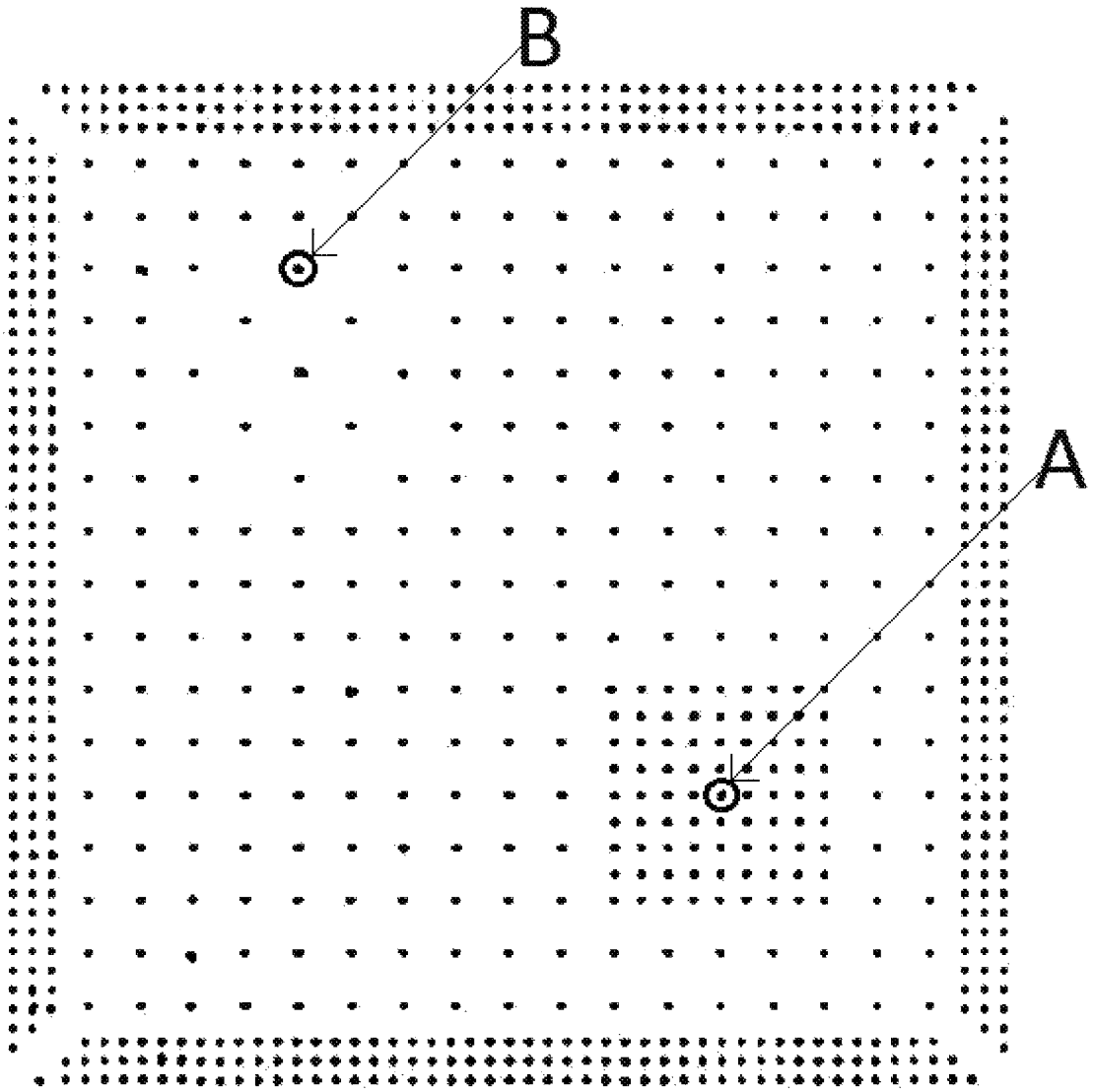
FIG. 1 is a schematic layout of the die which was used in Application Example 1. Pillars A and B which were used to analyze the results are highlighted as A and B.

The aqueous acidic copper plating bath for deposition of copper or copper alloys comprising a source of copper ions and an acid is characterised in that it further comprises a guanidine compound which contains at least one unit according to formula (I)

$$\text{-}\!\!\left[\text{A-D}\right]\!\!\text{-}_{a} \qquad \text{(I)}$$

wherein a is an integer ranging from 1 to 40, preferably from 2 to 30, more preferably from 3 to 20 and A represents a unit derived from a monomer according to the following formulae (A1) and/or (A2)

(A1)

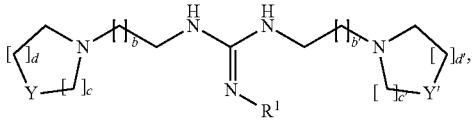

(A2)

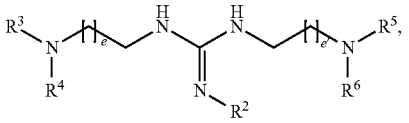

wherein

Y and Y' are each individually selected from the group consisting of $CH_2$, O and S; preferably, Y and Y' are the same;

$R^1$ is an organic residue selected from the group consisting of hydrogen, alkyl, aryl and alkaryl, preferably selected from the group consisting of hydrogen and alkyl;

$R^2$ is an organic residue selected from the group consisting of hydrogen, alkyl, aryl and alkaryl, preferably selected from the group consisting of hydrogen and alkyl;

$R^3$, $R^4$, $R^5$ and $R^6$ are each organic residues independently from each other selected from the group consisting of hydrogen, alkyl, aryl and alkaryl;

b and b' are integers each individually and independently from each other ranging from 0 to 6, preferably from 1 to 2, c and c' are integers each individually and independently from each other ranging from 1 to 6, preferably from 1 to 3; d and d' are integers each individually and independently from each other ranging from 0 to 6, preferably from 0 to 3, c, c', d and d' are more preferably selected with the proviso that the sum of c+d and c'+d' each ranges from 1 to 9, the sum of c+d and c'+d' even more preferably each ranges from 2 to 5;

e and e' are integers each individually and independently from each other ranging from 0 to 6, preferably from 1 to 2;

D is a divalent residue and is selected from the group consisting of $—Z^1—[Z^2—O]_g—Z^3—$, $—[Z^4—O]_h—Z^5—$, and $—CH_2—CH(OH)—Z^6—[Z^7—O]_i—Z^8—CH(OH)—CH_2—$, preferably from $—[Z^1—[Z^2—O]_g—Z^3—$ and $—[Z^4—O]_h—Z]^5—$ wherein $Z^1$ is an alkylene group with 1 to 6 carbon atoms, preferably 2 to 3 carbon atoms, $Z^1$ is more preferably selected from the group consisting of ethane-1,2-diyl and propane-1,3-diyl;

$Z^2$ is selected from the group consisting of alkylene group with 1 to 6 carbon atoms, aryl-substituted alkylene groups whereby the alkylene group comprises 1 to 6 carbon atoms and mixtures of the aforementioned, $Z^2$ is preferably selected from the group consisting of ethane-1,2-diyl, propane-1,3-diyl, propane-1,2-diyl, butane-1,2-diyl, 1-phenylethane-1,2-diyl and mixtures of the aforementioned, more preferably from ethane-1,2-diyl, propane-1,3-diyl, propane-1,2-diyl and mixtures of the aforementioned;

$Z^3$ is an alkylene group with 1 to 3 carbon atoms, preferably 2 to 3 carbon atoms, $Z^3$ is more preferably selected from the group consisting of ethane-1,2-diyl and propane-1,3-diyl;

$Z^4$ is selected from the group consisting of alkylene group with 1 to 6 carbon atoms, aryl-substituted alkylene groups whereby the alkylene group comprises 1 to 6 carbon atoms and mixtures of the aforementioned, $Z^4$ is preferably selected from the group consisting of ethane-1,2-diyl, propane-1,3-diyl, propane-1,2-diyl, butane-1,2-diyl, 1-phenylethane-1,2-diyl and mixtures of the aforementioned, more preferably from ethane-1,2-diyl, propane-1,3-diyl, propane-1,2-diyl and mixtures of the aforementioned;

$Z^5$ is an alkylene group with 1 to 3 carbon atoms, preferably 2 to 3 carbon atoms, $Z^5$ is more preferably selected from the group consisting of ethane-1,2-diyl and propane-1,3-diyl;

$Z^6$ is an alkylene group with 1 to 6 carbon atoms, preferably 2 to 3 carbon atoms, $Z^6$ is more preferably selected from the group consisting of methane-1,1-diyl, ethane-1,2-diyl and propane-1,3-diyl;

$Z^7$ is selected from the group consisting of alkylene group with 1 to 6 carbon atoms, aryl-substituted alkylene groups whereby the alkylene group comprises 1 to 6 carbon atoms and mixtures of the aforementioned, $Z^7$ is preferably selected from the group consisting of ethane-1,2-diyl, propane-1,3-diyl, propane-1,2-diyl, butane-1,2-diyl, 1-phenylethane-1,2-diyl and mixtures of the aforementioned, more preferably from ethane-1,2-diyl, propane-1,3-diyl, propane-1,2-diyl and mixtures of the aforementioned;

$Z^8$ is an alkylene group with 1 to 3 carbon atoms, $Z^8$ is preferably select from the group consisting of methane-1,1-diyl, ethane-1,2-diyl and propane-1,3-diyl;

g is an integer ranging from 1 to 100, preferably from 1 to 20 or 2 to 20;

h is an integer ranging from 1 to 100, preferably from 1 to 20 or 2 to 20;

i is an integer ranging from 1 to 100, preferably from 1 to 20 or 2 to 20;

and wherein the individual units A and D may be the same or different which means that the individual units A are selected independently from each other, and the individual units D are selected independently from each other.

The guanidine compound may be linear or cross-linked. That means the guanidine compound is linear and/or cross-linked. Linear and crosslinked is to be understood that parts of the compound are linear while other parts are crosslinked.

In case of $Z^2$, $Z^4$ and $Z^7$ the term "mixtures of the aforementioned" is to be understood that a guanidine compound according to the invention may comprise two or more of the residues from the group from which they are to be selected if g, h and/or i are 2 or higher. Exemplarily, this includes the use of copolymers or terpolymers made of ethylene oxide and propylene oxide or other alkylene oxides such as butylene oxide and styrene oxide. The groups $Z^1$ to $Z^8$ may be the same or different (and are thus selected independently from each other), the integers a to i are chosen independently from each other (unless provisos are explicitly mentioned).

In a preferred embodiment of the present invention, the guanidine compound comprises one or more units according to formula (I) and one or more of terminating groups $P^1$ and/or one or more of terminating groups $P^2$ whereby terminating groups $P^1$ can be bound to a unit A derived from monomers according to formulae (A1) and/or (A2) and terminating groups $P^2$ can be bound to divalent residues D, respectively, in the unit according to formula (I). The terminating group $P^1$ can be selected from the group consisting of

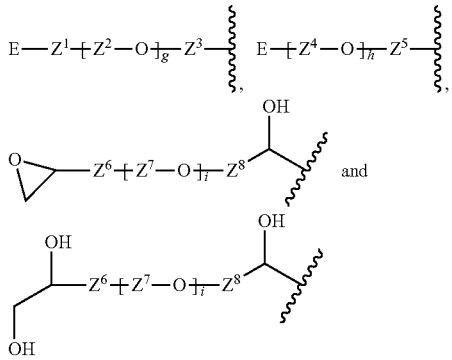

wherein the individual groups $Z^1$ to $Z^8$ as well as g to i are selected from above-defined groups and E is a leaving group and selected from the group consisting of triflate, nonaflate, alkylsulphonate such as methanesulphonate (also referred to as mesylate herein), arylsulphonate such as tosylate, p-benzosulphonate, p-nitrobenzosulphonate, p-bromobenzosulphonate and halogenides such as chloride, bromide and iodide.

The terminating group $P^2$ can be selected from the group consisting of hydroxyl group (—OH), a unit derived from monomers according to formulae (A1) and/or (A2), leaving group E

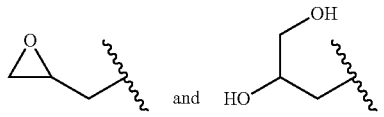

wherein the individual groups E and monomers according to formulae (A1) and/or (A2) are selected from above-defined groups.

In a particularly preferred embodiment of the present invention, the guanidine compound according to the invention consists of a unit according to formula (I) and terminating groups $P^1$ and/or $P^2$. Even more preferred, the guanidine compound according to the invention consists of the unit according to formula (I) and terminating groups $P^2$. Most preferred, the guanidine compound according to the invention consists of the unit according to formula (I) and terminating groups $P^2$ derived from monomers according to formulae (A1) and/or (A2).

The guanidine compounds are obtainable by a reaction of one or more of monomers according to formulae (A1) and/or (A2) with one or more of monomers B according to formulae (B1) to (B3), preferably monomers B according to formulae (B1) to (B2),

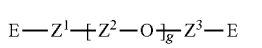

(B1)

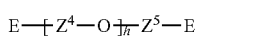

(B2)

-continued

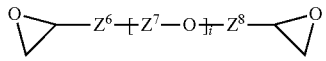

(B3)

wherein the individual groups E, $Z^1$ to $Z^8$ as well as g to i are selected from above-defined groups. If more than one residue from one group is to be selected they may be selected to be the same or different. Monomers according to formulae (A1) and/or (A2) can be synthesized by means known in the art such as the method disclosed in DE 30 03 978 and WO 2011/029781 A1. Derivatives with residues $R^1$ and/or $R^2$ bound to the guanidine moiety can be synthesized by amination of the respective thiourea derivative. The molecular ratio of monomers according to formulae (A1) and/or (A2) to monomers according to formulae (B1) to (B3) preferably ranges from 1.0 to 1.5 (overall equivalents of monomers according to formulae (A1) and/or (A2)) to 1 (overall equivalents of monomers according to formulae (B1) to (B3)).

Such a reaction of one or more of monomers according to formulae (A1) and/or (A2) with one or more of monomers according to formulae (B1) to (B3) can be carried out in a protic and/or polar solvent as reaction medium. Suitable solvents are water, glycols and alcohols, water being preferred. The reaction is carried out at a temperature ranging from 20 to 100° C. or the boiling point of the reaction medium, preferably between 30 and 90° C. The reaction is preferably run until the starting materials are completely consumed or for the time from 10 minutes to 96 hours, preferably 2 to 24 hours.

The guanidine compounds can be purified if necessary by any means known to those skilled in the art. These methods include precipitation (of products or of undesired impurities), chromatography, distillation, extraction, flotation or a combination of any of the aforementioned. The purification method to be used depends on the physical properties of the respective compounds present in the reaction mixture and has to be chosen for each individual case. In a preferred embodiment of the present invention, the purification comprises at least one of the following methods selected from the group consisting of extraction, chromatography and precipitation. Alternatively, the guanidine compounds according to the invention can be used without further purification.

The linkages between monomers according to formulae (A1) and/or (A2) and monomers according to formulae (B1) to (B3) occur via quaternary ammonium groups, which are formed linking the divalent monomers according to formulae (B1) to (B3) with the tertiary amino groups and/or the guanidine moieties of the monomers according to formulae (A1) and/or (A2). Such quaternary ammonium groups are to be understood in the context of the present invention to be formed from the tertiary amines and/or the guanidine moieties present in the monomers A1 and/or A2. An entirely linear guanidine compound is present if all monomers according to formulae (A1) and/or (A2) present in a guanidine compound are bound to one or two monomers according to formulae (B1) to (B3). A cross-linked guanidine compound is to be understood if one or more monomers according to formulae (A1) and/or (A2) are bound to three or more monomers according to formulae (B1) to (B3). The amount of cross-linkage can be obtained from standard analytical methods such as NMR spectrums of the guanidine compounds and/or titration methods to determine the nitrogen contents in order to differentiate between different amine types from primary to quaternary amines.

If any terminal tertiary amino groups may be present in the guanidine compounds according to formula (I), they may be quaternized in accordance with the desired properties by using an organic (pseudo)monohalide, such as benzyl chloride, allyl chloride, alkyl chloride, such as 1-chloro-hexane or their corresponding bromides and mesylates, or by using an appropriate mineral acid, such as hydrochloric acid, hydrobromic acid, hydroiodic acid or sulphuric acid. The guanidine compounds according to the invention preferably do not contain any organically bound halogen, such as a covalent C—Cl moiety.

The guanidine compounds according to the invention preferably have a weight average molecular mass $M_W$ of 500 to 50000 Da, more preferably of 1000 to 10000 Da, even more preferably of 1100 to 3000 Da as this obviates the risk of undesired nodule formation on formed copper pillars (see Table 2 of Application Example 2, compare GC1 versus GC4).

In another embodiment of the present invention, halide ions serving as the counter ions of the positively charged guanidine compounds according to the invention are replaced after preparation of the guanidine compound according to the invention by anions such as methane sulphonate, hydroxide, sulphate, hydrogen sulphate, carbonate, hydrogen carbonate, alkylsulphonate such as methane sulphonate, alkarylsulphonate, arylsulphonate, alkylcarboxylate, alkarylcarboxylate, arylcarboxylate, phosphate, hydrogenphosphate, dihydrogenphosphate, and phosphonate. The halide ions can be for example replaced by ion exchange over a suitable ion exchange resin. The most suitable ion exchange resins are basic ion exchange resins such as Amberlyst® A21. Halide ions can then be replaced by adding an inorganic acid and/or an organic acid containing the desired anions to the ion exchange resin. The enrichment of halide ions in the aqueous acidic copper plating bath during use can be avoided if the guanidine compounds according to the invention contain anions other than halide ions.

In so far as the term "alkyl" is used in this description and in the claims, it refers to a hydrocarbon radical with the general chemical formula $C_qH_{2q+1}$, q being an integer from 1 to about 24, preferably q ranges from 1 to 12, more preferably from 1 to 8, even more preferably alkyl is selected from methyl, ethyl and 2-hydroxy-1-ethyl. Alkyl residues according to the present invention can be linear and/or branched and they can be saturated and/or unsaturated. If the alkyl residues are unsaturated the corresponding general chemical formula has to be adjusted accordingly. $C_1$-$C_8$-alkyl for example includes, among others, methyl, ethyl, n-propyl, iso-propyl, n-butyl, iso-butyl, tert-butyl, n-pentyl, iso-pentyl, sec-pentyl, tert-pentyl, neo-pentyl, hexyl, heptyl and octyl. Alkyl can be substituted by replacing individual hydrogen atoms in each case by a functional group, for example amino, hydroxy, halides such as fluoride, chloride, bromide, iodide, carbonyl, carboxyl, carboxylic acid esters and so forth.

In so far as the term "alkylene" is used in this description and in the claims, it refers to a hydrocarbon diradical with the general chemical formula $C_rH_{2r}$, r being an integer from 1 to about 24 (unless stated otherwise). Alkylene residues according to the present invention can be linear and/or branched and they can be saturated and/or unsaturated. If the alkylene residues are unsaturated the corresponding general chemical formula has to be adjusted accordingly. $C_1$-$C_4$-alkylene for example includes, among others, methane-1,1-diyl, ethane-1,2-diyl, ethane-1,1-diyl, propane-1,3-diyl, propane-1,2-diyl, propane-1,1-diyl, butane-1,4-diyl, butane-1,3-diyl, butane-1,2-diyl, butane-1,1-diyl, butane-2,3-diyl. Furthermore, individual hydrogen atoms bound to the alkylene compound may in each case be substituted by a functional group such as those defined above for the alkyl group.

In so far as the term "aryl" is used in this description and in the claims, it refers to aromatic ring-shaped hydrocarbon groups, for example phenyl or naphtyl, wherein individual ring carbon atoms may be replaced by N, O and/or S, for example benzothiazolyl or pyridinyl. Furthermore, individual hydrogen atoms bound to the aromatic compound may in each case be substituted by a functional group such as those defined above for the alkyl group. Bonding sites to other molecular entities are sometimes herein depicted as wavy lines (§) as it is common in the art.

In so far as the term "alkaryl" is used in this description and in the claims, it refers to hydrocarbon groups comprising at least one aryl and at least one alkyl group such as benzyl and p-tolyl. The bonding of such an alkaryl group to other moieties may occur via the alkyl or the aryl group of the alkaryl group.

The guanidine compound according to the invention acts as leveller in a copper or copper alloy plating bath. The levelling function and the term "leveller" means the following: Using the aqueous acidic copper plating bath according to the invention and the method according to the invention, it is possible to deposit copper in a very uniform manner in the structures that are to be filled, as recessions and depressions. In particular, it is possible to fill recessions and depressions totally, reduce a deposition of copper on the surface compared to deposition in the depressions/recessions, and to avoid or at least minimize any voids or dimples. This guarantees that an extensively smooth, even copper surface is formed that exhibits practically no deformations.

The concentration of the at least one guanidine compound according to the invention in the inventive aqueous acidic copper plating bath preferably ranges from 0.01 mg/l to 1000 mg/l, more preferably from 0.1 mg/l to 100 mg/l and even more preferably from 0.5 mg/l to 50 mg/l and yet even more preferably from 1 or 5 mg/l to 20 mg/l. If more than one guanidine compound is used, the overall concentration of all guanidine compounds used is preferably in above-defined ranges.

The aqueous acidic copper plating bath according to the invention is an aqueous solution. The term "aqueous solution" means that the prevailing liquid medium, which is the solvent in the solution, is water. Further liquids, that are miscible with water, as for example alcohols and other polar organic liquids, that are miscible with water, may be added.

The aqueous acidic copper plating bath according to the invention may be prepared by dissolving all components in aqueous liquid medium, preferably in water.

The aqueous acidic copper plating bath according to the invention further contains at least one source of copper ions. Suitable source of copper ions can be any water soluble copper salts or copper complexes. Preferably, the source of copper ions is selected from the group consisting of copper sulphate, copper alkyl sulphonates such as copper methane sulphonate, copper chloride, copper acetate, copper citrate, copper fluoroborate, copper phenyl sulphonate and copper p-toluene sulphonate, more preferably from copper sulphate and copper methane sulphonates. The copper ion concentration in the aqueous acidic copper plating bath preferably ranges from 4 g/l to 90 g/l.

The aqueous acidic copper plating bath according to the invention further contains at least one acid which is preferably selected from the group consisting of sulphuric acid, fluoroboric acid, phosphoric acid and methane sulphonic acid and is preferably added in a concentration of 10 g/l to 400 g/l, more preferably from 20 g/l to 300 g/l.

The aqueous acidic copper plating bath according to the invention preferably has a pH value of ≤3, more preferably of ≤2, even more preferably of ≤1.

The aqueous acidic copper plating bath according to the invention optionally further contains at least one accelerator-brightener additive. In so far as the term "brightener" is used in this description and in the claims, it refers to substances that exert a brightening and accelerating effect during the copper deposition process. The at least one optional accelerator-brightener additive is selected from the group consisting of organic thiol-, sulphide-, disulphide- and polysulphide-compounds. Preferred accelerator-brightener additives are selected from the group consisting of 3-(benzthiazolyl-2-thio)-propylsulphonic-acid, 3-mercaptopropan-1-sulphonic acid, ethylendithiodipropylsulphonic-acid, bis-(p-sulphophenyl)-disulphide, bis-(ω-sulphobutyl)-disulphide, bis-(ω-sulphohydroxypropyl)-disulphide, bis-(ω-sulphopropyl)-disulphide, bis-(ω-sulphopropyl)-sulphide, methyl-(ω-sulphopropyl)-disulphide, methyl-(ω-sulfopropyl)-trisulphide, O-ethyl-dithiocarbonic-acid-S-(ω-sulphopropyl)-ester, thioglycol-acid, thiophosphoric-acid-O-ethyl-bis-(ω-sulphopropyl)-ester, 3-N,N-dimethylaminodithiocarbamoyl-1-propanesulphonic acid, 3,3'-thiobis(1-propanesulphonic acid), thiophosphoric-acid-tris-(ω-sulphopropyl)-ester and their corresponding salts. The concentration of all accelerator-brightener additives optionally present in the aqueous acidic copper bath compositions preferably ranges from 0.01 mg/l to 100 mg/l, more preferably from 0.05 mg/l to 10 mg/l.

The aqueous acidic copper plating bath optionally further contains at least one carrier-suppressor additive. In so far as the term "carrier" is used in this description and in the claims, it refers to substances that exert an effect that they suppress (partially) or retard the copper deposition process. These are generally organic compounds, in particular high-molecular compounds that contain oxygen, preferably polyalkylene glycol compounds. The at least one optional carrier-suppressor additive is preferably selected from the group consisting of poly-vinylalcohol, carboxymethylcellulose, polyethylene glycol, polypropylene glycol, stearic acid polyglycolester, alkoxylated naphtholes, oleic acid polyglycolester, stearylalcoholpolyglycolether, nonylphenolpolyglycolether, octanolpolyalkylene glycolether, octanediol-bis-(polyalkylene glycolether), poly(ethylene glycol-ran-propylene glycol), poly(ethylene glycol)-block-poly(propylene glycol)-block-poly(ethylene glycol), and poly(propylene glycol)-block-poly(ethylene glycol)-block-poly(propylene glycol). More preferably, the optional carrier-suppressor additive is selected from the group consisting of polyethylene glycol, poly-propylene glycol, poly(ethylene glycol-ran-propylene glycol), poly(ethylene glycol)-block-poly(propylene glycol)-block-poly(ethylene glycol), and poly(propylene glycol)-block-poly(ethylene glycol)-block-poly(propylene glycol). The concentration of said optional carrier-suppressor additive preferably ranges from 0.005 g/l to 20 g/l, more preferably from 0.01 g/l to 5 g/l.

Optionally, the aqueous acidic copper plating bath contains in addition to the guanidine compound according to the invention at least one further leveller additive selected from the group consisting of nitrogen containing organic compounds such as polyethylene imine, alkoxylated polyethylene imine, alkoxylated lactams and polymers thereof, diethylene triamine and hexamethylene tetramine, organic dyes such as Janus Green B, Bismarck Brown Y and Acid Violet 7, sulphur containing amino acids such as cysteine, phenazinium salts and derivatives thereof, polyethylenimine bearing peptides, polyethylenimine bearing amino acids, polyvinyl alcohol bearing peptides, polyvinyl alcohol bearing amino acids, polyalkylene glycol bearing peptides, polyalkylene glycol bearing amino acids, aminoalkylene bearing pyrrols, aminoalkylene bearing pyridines and urea polymers. Suitable urea polymers have been disclosed in EP 2 735 627 A1, said polyalkylene glycol bearing amino acids and peptides are published in EP 2 113 587 B9 and EP 2 537 962 A1 teaches suitable aminoalkylene bearing pyrroles and pyridines. The preferred further leveller additive is selected from nitrogen containing organic compounds and urea polymers. Said optional leveller additive is added to the aqueous acidic copper plating bath in amounts of 0.1 mg/l to 100 mg/l.

The aqueous acidic copper plating bath optionally further contains at least one source of halide ions such as chloride, bromide, iodide and mixtures thereof, preferably chloride ions, more preferably chloride ions in a quantity of 20 mg/l to 200 mg/l, more preferably from 30 mg/l to 60 or up to 80 mg/l. Suitable sources for halide ions are for example hydrochloric acid or alkali halides such as sodium chloride.

Optionally, the aqueous acidic copper plating bath may contain at least one wetting agent. These wetting agents are also referred to as surfactants in the art. The at least one wetting agent may be selected from the group of non-ionic, cationic and/or anionic surfactants and is used in a concentration from 0.01 to 5 wt.-%.

In one embodiment of the present invention, the aqueous acidic copper plating bath comprises iron ions as second source of metal ions. Suitable sources of iron ions can be any water soluble ferric, ferrous salt and/or iron complex. Preferably, ferrous halides, ferrous sulphate, ammonium ferrous sulphate, ferrous nitrate, ferric halides, ferric sulphate, ferric nitrate, their respective hydrates and mixtures of the aforementioned can be employed as iron ion source. The concentration of iron ions in the aqueous acidic copper plating bath ranges from 100 mg/l to 10 g/l or 100 mg/l to 20 g/l. In yet another embodiment of the present invention, a redox couple, such as $Fe^{2+/3+}$ ions is added to the plating bath. Such a redox couple is particularly useful, if reverse pulse plating is used in combination with inert anodes for copper deposition. Suitable processes for copper plating using a redox couple in combination with reverse pulse plating and inert anodes are for example disclosed in U.S. Pat. Nos. 5,976,341 and 6,099,711.

Optionally, the aqueous acidic copper plating baths comprises at least one further source of reducible metal ions. Reducible metal ions are understood in the context of the present invention as those metal ions which can be co-deposited with copper to form a copper alloy (under the given conditions). In the context of the present invention, these further sources of reducible metal ions are preferably selected from the group consisting of sources of gold ions, sources of tin ions, sources of silver ions, and sources of palladium ions, more preferably selected from sources of gold ions and sources of silver ions. Suitable sources of said ions are water-soluble salts and/or water-soluble complexes of said metals. Generally, the total amount of further sources of reducible metal ions is preferably comprised in the acidic aqueous copper plating bath in an amount of up to 50 wt.-% in relation to the amount of copper ions contained therein, more preferably in an amount of up to 10 wt.-% in relation to the amount of copper ions, even more preferably up to 1 wt.-% in relation to the amount of copper ions, yet even more preferably up to 0.1 wt.-% in relation to the amount of copper ions. Alternatively and preferably, the aqueous acidic copper plating bath according to the invention is free of such further source of reducible metal ions.

The aqueous acidic copper plating bath according to the invention is preferably free of intentionally added zinc ions. Co-deposition of zinc and copper reduces the electrical conductivity of the formed deposit significantly compared to pure copper rendering such co-deposit of zinc and copper unsuitable for the use in the electronics industry. Since already small amounts of zinc in such a co-deposit of zinc and copper have above-described detrimental effect, it is preferred that the concentration of zinc ions in the aqueous acidic copper plating bath according to the invention is 1 g/l or below, more preferably 0.1 g/l or below, even more preferably 0.01 g/l or below or most preferably the aqueous acidic copper plating bath according to the invention is substantially free of zinc ions.

Moreover, zinc exhibits a higher diffusivity in silicon or germanium than copper, hence, the incorporation of zinc might lead to unwanted electromigration effects.

In a preferred embodiment of the present invention, the aqueous acidic copper plating bath contains only copper ions as reducible metal ions (disregarding traces of impurities commonly present in technical raw materials and above-mentioned redox couple). It is known in the art that the deposition from any electrolytic copper plating bath may be hampered by the presence of other reducible metal ions besides copper. A copper bath containing also arsenic and/or antimony is exemplarily known to produce brittle and rough copper deposits and thus it is preferred that the aqueous acidic copper plating bath is free from intentionally added arsenic and/or antimony ions. Nickel as further metal ion source is known not to be co-deposited along with copper from an acidic plating bath in an electrolytic process, but it reduces the conductivity of such a bath and thus makes the electrolytic deposition then less efficient (cf. page 75 of "Modern Electroplating", 4$^{th}$ Edition, 2000, edited by M. Schlesinger, M. Paunovi, John Wiley & Sons, Inc., New York). Therefore, it is preferred that the aqueous acidic copper plating bath according to the invention is free from (intentionally added) further reducible metal ions including ions of nickel, cobalt, zinc, arsenic, antimony, bismuth, lead, tungsten, molybdenum, rhenium, ruthenium, rhodium, osmium, iridium, platinum, mercury. Non-reducible metal ions include inter alia alkaline and earth alkaline metal ions which cannot be reduced under the conditions typically applied.

It is particularly preferred that the aqueous acidic copper plating bath is capable to form pure copper deposits and thus is free of (intentionally added) sources of ions of nickel, cobalt, zinc, silver, gold, arsenic, antimony, bismuth, tin, lead, tungsten, molybdenum, rhenium, ruthenium, rhodium, palladium, osmium, iridium, platinum, and mercury. More preferably, the aqueous acidic copper plating bath according to the invention contains less than 1 g/l of the above named reducible metal ions, even more preferably less than 0.1 g/l of the above named reducible metal ions, yet even more preferably less than 0.01 g/l of the above named reducible metal ions, most preferably it is substantially free of such reducible metal ions listed above.

In one preferred embodiment, no further metal is added to the aqueous acidic copper plating bath and pure copper is thus deposited (disregarding any trace impurities commonly present in technical raw materials). As outlined above, in this preferred embodiment, no further source of reducible metal ions is (intentionally) added to the aqueous acidic copper plating bath whereby pure copper is thus deposited. Pure copper is particularly useful in the semiconductor industry due to its high conductivity. This means in the context of the present invention a copper content of more than 95 wt.-% based on the entire metal content in a deposit formed, preferably more than 99 wt.-%, more preferably more than 99.9 wt.-%, most preferably more than 99.99 wt.-%. In a more preferred embodiment, the deposits formed consist of 95 wt.-% copper, preferably more than 99 wt.-% copper, more preferably more than 99.9 wt.-% copper, most preferably more than 99.94 wt.-% copper.

A method for deposition of copper or copper alloy onto a substrate comprising, in this order, the steps (i) providing a substrate, (ii) contacting the substrate with an aqueous acidic copper plating bath comprising at least one source of copper ions, at least one acid and at least one guanidine compound according to the invention, and (iii) applying an electrical current between the substrate and at least one anode, and thereby depositing copper or copper alloy on at least a portion of the surface of the substrate. Copper and copper alloy deposits can be made with the method according to the invention.

The substrate is preferably selected from the group consisting of printed circuit boards, IC substrates, circuit carriers, interconnect devices, ceramics, semiconductor wafers and glass substrates; more preferably, the substrate is selected from the group consisting of printed circuit boards, IC substrates, circuit carriers, interconnect devices, semiconductor wafers and glass substrates. Particularly preferred are substrates of the afore-mentioned groups which have recessed structures such as trenches, blind micro vias, through silicon vias, through glass vias, particularly those recessed structures which can be used to build up redistribution layers and copper pillars (also referred to as copper pillar bumps). Therefore, the use of the inventive method allows for the deposition of copper or copper alloys into recessed structures and the build-up of redistribution layers and copper pillars. Particularly preferred is the formation of copper pillars with the inventive method. The height of such formed copper pillars preferably ranges from 10 to 100 μm.

Preferably, the method according to the invention is used to deposit pure copper. Pure copper shall mean in the context of the present invention a copper content of the deposit of more than 95 wt.-%, preferably more than 99 wt.-%, more preferably more than 99.9 wt.-%, most preferably more than 99.94 wt.-% (see Application Example 1). Optionally, solder cap layers (also denominated solder bumps in the art) such as those comprising tin, silver or alloys thereof, preferably tin and tin alloys, may be deposited on the top portion of such formed copper pillars in accordance with the teachings of US 2009/0127708. The copper pillars may be coated with a noble metal using the method disclosed in EP 2 711 977 A1. Such copper pillars and solder caps may then be subjected to a heat treatment often referred to in the art as "reflow treatment" which results in the formation of copper tin or copper tin silver intermetallic phases.

The aqueous acidic copper plating bath is preferably operated in the method according to the present invention in a temperature range of 15° C. to 50° C., more preferably in a temperature range of 25° C. to 40° C. by applying an electrical current to the substrate and at least one anode.

Preferably, a cathodic current density range of 0.05 $A/dm^2$ to 50 $A/dm^2$, more preferably 0.1 $A/dm^2$ to 30 $A/dm^2$ is applied.

The substrate is contacted with the aqueous acidic copper plating bath for any time length necessary to deposit the desired amount of copper. This time length preferably ranges from 1 second to 6 hours, more preferably for 5 seconds to 120 minutes, even more preferably for 30 seconds to 75 minutes.

The substrate and the aqueous acidic copper plating bath can be contacted by any means known in the art. This includes inter alia immersion of the substrate into the bath or the use of other plating equipment. The aqueous acidic copper plating bath according to the present invention can be used for DC plating (direct current plating), alternating current plating and reverse pulse plating. Both inert and soluble anodes can be utilized when depositing copper from the plating bath according to the present invention.

The aqueous acidic copper plating bath can be either used in conventional vertical or horizontal plating equipment. The substrate or at least a portion of its surface may be contacted with the aqueous acidic copper plating bath according to the invention by means of spraying, wiping, dipping, immersing or by other suitable means. Thereby, a copper or copper alloy layer is obtained on at least a portion of the surface of the substrate.

It is preferential to agitate the aqueous acidic copper plating bath during the plating process, i.e. the deposition of copper or copper alloy. Agitation may be accomplished for example by mechanical movement of the inventive aqueous acidic copper plating bath like shaking, stirring or continuously pumping of the liquids or by ultrasonic treatment, elevated temperatures or gas feeds (such as purging the electroless plating bath with air or an inert gas such as argon or nitrogen).

The method according to the invention may comprise further cleaning, etching, reducing, rinsing, chemical-mechanical planarization and/or drying steps all of which are known in the art.

It is an advantage of the present invention that the inventive aqueous acidic copper plating bath allow for copper or copper layers with very few organic impurities to be formed (compare the resultant organic impurities of the aqueous acidic copper plating baths containing polyethylenimine and guanidine compound as levellers, see table 2). This is particularly desired for semiconductor applications as this leads to bigger copper or copper alloy grains with less voids to be deposited which in turn results in better conductivity of the copper or copper alloy layers. Advantageously and preferably, the use of the inventive aqueous acidic copper plating bath and the method according to the invention allow for copper deposits to be formed which contain less than 1000 mg of organic impurities per kilogram of copper deposit, more advantageously and more preferably, less than 800 mg of organic impurities per kilogram of copper deposit, even more advantageously and even more preferably, less than 600 mg of organic impurities per kilogram of copper deposit.

Organic impurities can for example be incorporated into the copper deposit from organic or polymeric additives used in the aqueous acidic copper plating bath such as levellers, solvents, surfactants/wetting agents, brighteners and carriers. Typically, they are found as organic or polymeric compounds comprising the elements carbon, hydrogen, halides, sulphur, nitrogen and oxygen.

It is an advantage of the present invention that the inventive aqueous acidic copper plating bath results in homogenous heights of formed copper pillar bumps. Advantageously, the difference of the highest and lowest point in height of individual pillars formed with such an inventive aqueous acidic copper plating bath is very low (referred to as "spread" in table 1) and the copper pillars are evenly formed. A very high plating rate can be achieved as high current densities are feasible using the inventive aqueous acidic copper plating bath.

The invention will now be illustrated by reference to the following non-limiting examples. The terms copper pillars and copper pillar bumps are used interchangeably herein.

EXAMPLES $^1$H-NMR spectrums were recorded at 250 MHz with a spectrum offset of 4300 Hz, a sweep width of 9542 Hz at 25° C. (Varian, NMR System 500). The solvent used was $D_2O$.

The weight average molecular mass $M_W$ of the guanidine compounds was determined by gel permeation chromatography (GPC) using a GPC apparatus from WGE-Dr. Bures equipped with a molecular weight analyzer BI-MwA from Brookhaven, a TSK Oligo +3000 column, and Pullulan and PEG standards with $M_W$=400 to 22000 g/mol. The solvent used was Millipore water with 0.5% acetic acid and 0.1 M $Na_2SO_4$.

Preparation of Guanidine Compound 1 (GC 1)

A reactor equipped with reflux condenser was charged with 10.00 g (43.6 mmol, 1.33 equivalents) 1,3-Bis-(3-(dimethylamino)-propyl)-guanidine in 20.02 g water. Then, 10.02 g (32.7 mmol) (ethane-1,2-diylbis(oxy))bis(ethane-2,1-diyl)-dimethanesulphonate were added to this solution at room temperature. The reaction mixture was stirred at 80° C. for 5 hours and an aqueous solution containing 50 wt.-% of Guanidine compound 1 as methane sulphonate salt was obtained.

Analytical data: GPC: $M_w$=1800 g/mol, polydispersity: 1.9, NMR: δ=1.63 (m, 2H), 1.76 (m, 4H), 1.99-2.09 (m, 11H), 2.19-2.23 (4 individual s, 15H), 2.37 (m, 6H), 2.61, 2.70 (2×t, 4H), 2.81 (s, 18H), 3.11 (q, 2H), 3.15-3.17 (3 individual s, 29H), 3.22-3.29 (m, 12H), 3.44 (m, 11H), 3.59 (m, 10H), 3.71-3.75 (3×s, 14H), 3.98 (m, 10H).

Preparation of Guanidine Compound 2 (GC 2)

A reactor equipped with reflux condenser was charged with 25.00 g (109 mmol, 1.33 equivalents) 1,3-Bis-(3-(dimethylamino)-propyl)-guanidine in 46.44 g water. Then, 10.02 g (82 mmol) oxybis(ethane-2,1-diyl) dimethanesulfonate were added to this solution at room temperature. The reaction mixture was stirred at 80° C. for 5 hours and an aqueous solution containing 50 wt.-% of Guanidine compound 2 as methane sulphonate salt was obtained.

Analytical data: GPC: $M_w$=1700 g/mol, polydispersity: 1.3, NMR: δ=1.60-1.75 (m, 6H), 1.76 (m, 4H), 1.92-2.07 (m, 10H), 2.19-2.21 (4 individual s, 12H), 2.33-2.38 (m, 5H), 2.61, 2.70 (2×t, 4H), 2.81 (s, 16H), 3.15-3.17 (3 individual s, 29H), 3.22-3.29 (m, 12H), 3.42 (m, 10H), 3.64 (m, 10H), 3.98 (m, 10H).

Preparation of Guanidine Compound 3 (GC 3)

Following the procedure for the preparation of guanidine compound 1 and using A reactor equipped with reflux condenser was charged with 25.00 g (109 mmol, 1.33 equivalents) 1,3-Bis-(3-(dimethylamino)-propyl)-guanidine in 56.65 g water. Then, 28.65 g (82 mmol) ((oxybis(ethane-2,1-diyl))bis(oxy))bis(ethane-2,1-diyl) dimethanesulfonate were added to this solution at room temperature. The reaction mixture was stirred at 80° C. for 5 hours and an aqueous solution containing 50 wt.-% of Guanidine compound 3 as methane sulphonate salt was obtained.

Analytical data: GPC: $M_w$=2100 g/mol, polydispersity: 1.5, NMR: δ=1.63-1.76 (m, 6H), 1.93-2.09 (m, 11H), 2.19-2.21 (4 individual s, 12H), 2.35-2.40 (m, 5H), 2.61, 2.70 (2×t, 4H), 2.81 (s, 16H), 3.15-3.17 (3 individual s, 29H), 3.22-3.31 (m, 10H), 3.44 (m, 10H), 3.59-3.73 (m, 34H), 3.97 (m, 10H).

Preparation of Guanidine Compound 4 (GC 4)

A reactor equipped with reflux condenser was charged with 10.00 g (43.6 mmol, 1.33 equivalents) 1,3-Bis-(3-(dimethylamino)-propyl)-guanidine in 16.24 g water. Then, 6.24 g (32.7 mmol) 1,2-bis(2-chloroethoxy)ethane were added to this solution at room temperature. The reaction mixture was stirred at 80° C. for 21 hours and an aqueous solution containing 50 wt.-% of Guanidine compound 4 as chloride salt was obtained.

Analytical data: GPC: $M_w$=3100 g/mol, polydispersity: 1.6, NMR: δ=1.66 (m, 2H), 1.76 (m, 4H), 1.99-2.13 (m, 8H), 2.21-2.24 (2 individual s, 12H), 2.37-2.41 (m, 4H), 2.69-2.722.70 (m, 4H), 3.16-3.22 (m, 28H), 3.34-348 (m, 12H), 3.60-3.75 (m, 19H), 3.98 (m, 8H).

Application Example 1

All application experiments were done with an Autolab PGSTAT302N from Metrohm Deutschland GmbH employing a soluble copper anode.

The profiles of the obtained copper pillars were analyzed with a Dektak 8 pro-filometer from Veeco Instruments Inc. after removal of the photo resist.

For the analysis of the purity of the deposited copper a time-of-flight secondary-ion-mass-spectroscopy device was employed: TOF.SIMS 5 from IONTOF GmbH. Additionally, standards created by ion implantation were deployed.

Pillar-coupons (i. e. silicon wafer pieces covered with a sputtered copper seed layer and patterned with a photo resist pillar bumps test mask) were used for the electroplating experiments. One pillar-coupon comprised nine dies arranged in a 3×3 matrix. The layout of one die is displayed in FIG. 1 and FIG. 2. The pillar-coupons were attached and contacted with an adhesive copper tape to a special coupon holder that was harnessed in place of a rotational disc electrode. The plating area was formed with the help of an insulating tape. The pillar-coupons were pre-treated with a copper cleaner in a desiccator and rinsed thoroughly with deionized water before the electroplating experiment. Only the centre die was evaluated. The exact location of the pillars A and B which were used for analyzing the results can be found in FIG. 1.

The process parameters were set as follows: coupon rotation=300 rpm, current densities=1 A/dm$^2$ for 273 s and 10 A/dm$^2$ for 378 s.

Each solution comprised 50 g/l copper ions (added as copper sulphate), 100 g/l sulphuric acid, 50 mg/l chloride ions, 10 ml/l Spherolyte Cu200 Brightener (product of Atotech Deutschland GmbH), 12 ml/l Spherolyte Carrier 11 (product of Atotech Deutschland GmbH), and the tested additive in one of the concentrations given below.

Three additives were tested in application example 1:

a) Guanidine compound 1 (abbreviated as GC1, inventive)

b) urea polymer, preparation example 8 as disclosed in EP 2735627 (abbreviated as UP, comparative)

c) polyethylenimine, branched, $M_w$ 25000 g/mol (abbreviated as PEI, comparative)

The results of the obtained profiles for aqueous acidic copper plating bath containing 1 mg/l of the additives are summarized in Table 1. The "spread" is herein defined as the difference of the maximum and the minimum height of a pillar.

TABLE 1

Copper pillar formation.

| | Pillar A | | | Pillar B | | |
|---|---|---|---|---|---|---|
| Additive | Mean height [μm] | Spread [μm] | Spread [%] | Mean height [μm] | Spread [μm] | Spread [%] |
| Guanidine compound 1 (GC1) | 17.8 | 3.3 | 18.5 | 18.3 | 3.7 | 20.2 |
| Urea polymer (UP) | 10.5 | 2.3 | 21.2 | 14.3 | 6.0 | 42.0 |
| Polyethylen-imine (PEI) | 18.8 | 7.3 | 38.8 | 18.7 | 7.3 | 39.0 |

Copper pillars were formed with aqueous acidic copper plating bath containing any of the three additives. However, the size of the individual copper pillars and their spread varied much more strongly in case of the aqueous acidic copper plating bath containing the urea polymer. Although the mean height of the copper pillars formed with an aqueous acidic copper plating bath containing polyethylene imine was very even, their spread was also high just as in the case of the aqueous acidic copper plating bath containing the urea polymer. Copper pillars formed with an aqueous acidic copper plating bath containing Guanidine compound 1 were evenly high and showed a significantly reduced spread compared to the aqueous acidic copper electroplating baths containing the comparative additives. Also, the height of the individual pillars was sufficient.

Table 2 shows the impurity contents of the obtained copper pillar bumps. The samples were analyzed with the help of a depth profile of approximately 1000 nm to 1100 nm in depth, where a measurement was taken approximately every 4 nm to 5 nm. The data was recorded quantitatively for the elements C, O, N, S, and Cl.

The data given in Table 2 represents the average of the depth range between 600 nm to 1000 nm, which represents the bulk of the deposited copper. The averages are given in parts per million (ppm herein is an equivalent to mg/kg) and were calculated by dividing the concentration of a given contamination element in atoms/cm$^3$ by the number of copper atoms in a cm$^3$ (8.49103E+22) and multiplying this by 1 000 000.

A sample of highly pure copper was measured, in order to check the consistency of the data and to identify day to day variations. All data had an error up to a factor of 2.

TABLE 2

Organic impurities in copper pillar bumps.

| Additive | Conc. [mg/L] | C [mg/kg] | O [mg/kg] | S [mg/kg] | Cl [mg/kg] | N [mg/kg] | Total [mg/kg] |
|---|---|---|---|---|---|---|---|
| GC 1 | 1 | 39 | 123 | 2 | 2 | 380 | 546 |
| GC 1 | 10 | 19 | 54 | 1 | 1 | 128 | 203 |
| PEI | 0.1 | 354 | 241 | 14 | 20 | 438 | 1067 |
| PEI | 1 | 137 | 162 | 54 | 121 | 862 | 1336 |
| PEI | 10 | 447 | 307 | 201 | 430 | 2908 | 4293 |

As can be seen, copper pillars formed with an aqueous acidic copper plating bath containing Guanidine compound 1 (GC 1) exhibited a lower contamination compared to those made from a copper plating bath containing polyethylenimine.

Application Example 2

Figure 2:
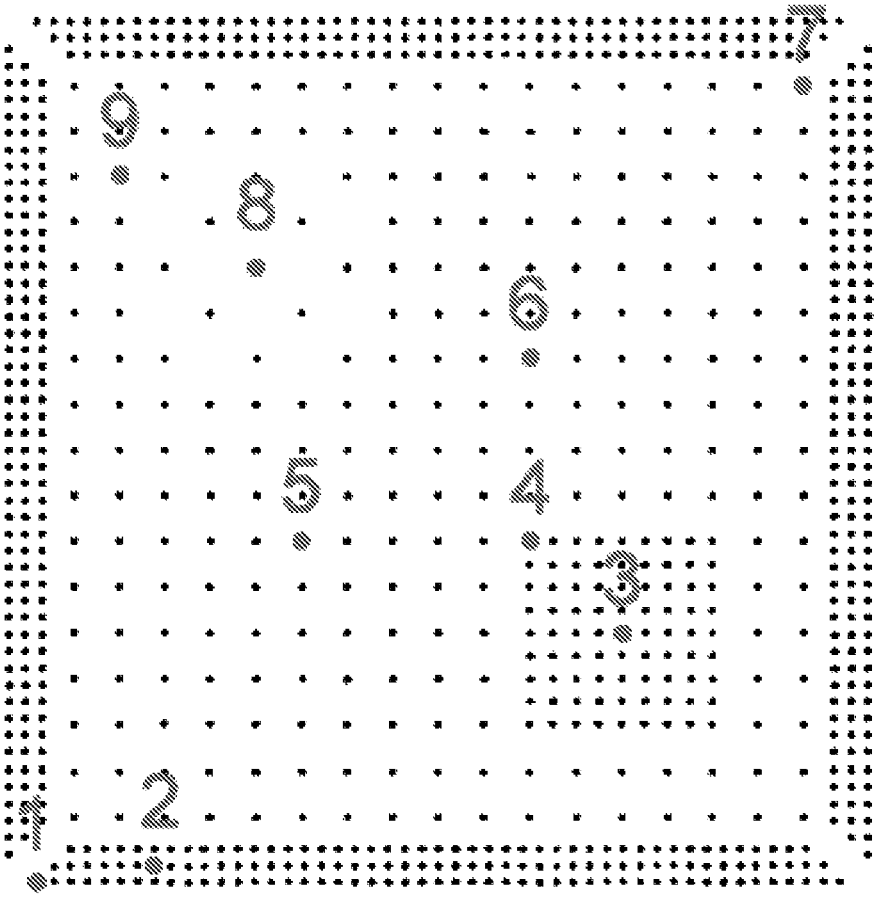
FIG. 2 is a schematic layout of the die which was used in Application Example 2. Pillars 1 to 9 which were used to analyze the results are highlighted with the numerals 1 to 9 and the pillars in the scheme are depicted in bold face.

As described above for Application Example 1, copper pillars were formed on coupons (i.e. dies) and 9 individual copper pillars on the centre die of each coupon were selected for the analysis of the copper pillar formation quality (see FIG. 2).

Again, solutions each comprising 50 g/l copper ions (added as copper sulphate), 100 g/l sulphuric acid, 50 mg/l chloride ions, 10 ml/l Spherolyte Cu200 Brightener (product of Atotech Deutschland GmbH), 12 ml/l Spherolyte Carrier 11 (product of Atotech Deutschland GmbH), and the tested additives in concentrations as given in the following Table 3 were used. The conditions and parameters as described in Application Example 1 were employed in this Application Example as well.

The copper pillars were measured as described below and analyzed using the following definitions for the assessment of the copper pillar formation quality.

WIP: Within profile non-uniformity. Calculated by the equation given below:

$$100 \times \frac{Z_{max}(\text{pillar}) = Z_{min}(\text{pillar})}{2 \times Z_{av}(\text{pillar})}$$

WID: Within die non-uniformity. Calculated by the equation given below:

$$100 \times \frac{Z_{av}(\text{pillar})\text{max} - Z_{av}(\text{pillar})\text{min}}{2 \times Z_{av}(\text{die})}$$

In the above-defined formulae, the following abbreviations were used:

$Z_{max}$(pillar): Height of the highest point on the top of a pillar.

$Z_{min}$(pillar): Height of the lowest point on the top of a pillar.

$Z_{av}$(pillar): Average height of a pillar.

$Z_{av}$(pillar)max: Highest value of all $Z_{av}$(pillar) values of the considered die $Z_{av}$(pillar)min: Lowest value of all $Z_{av}$(pillar) values of the considered die $Z_{av}$(die): Average value of all $Z_{av}$(pillar) values of the considered die The nine pillar bumps of the centre die shown in FIG. 2 were chosen to calculate the average heights, the within pillar (WIP) non-uniformity and the within die (WID) non-uniformity displayed in Table 3. The height, Z, profile of the pillar bumps were determined with the help of a white light interference microscope MIC-250 from Atos GmbH, Germany. The average values, the minima and maxima values as well as the WIP and the WID non-uniformities were calculated from these results.

The results are summarized in the following table 3.

TABLE 3

Copper pillar quality.

| Additive | Conc. [mg/L] | Average Height [μm] | WIP [%] | WID [%] |
|---|---|---|---|---|
| GC 1 (inventive) | 1 | 16.9 | 10.3 | 11.9 |
| | 5 | 14.7 | 6.2 | 3.6 |
| | 10 | 14.7 | 9.8 | 5.5 |
| GC 2 (inventive) | 1 | 17.0 | 9.9 | 7.4 |
| | 10 | 15.3 | 6.9 | 3.8 |
| GC 3 (inventive) | 1 | 16.8 | 9.0 | 13.0 |
| | 5 | 15.6 | 6.2 | 2.4 |
| | 10 | 15.6 | 6.9 | 3.8 |
| GC 4 (inventive) * | 1 | 18.3 | 11.9 | 3.7 |
| | 10 | 13.1 | 9.3 | 5.6 |
| UP (comparative) * | 1 | 11.5 | 14.8 | 11.9 |
| | 10 | 10.2 | 10.2 | 2.3 |

* = The coupons of these samples exhibited nodules in the corner dies when 10 mg/L of the tested additive was employed.

It is obvious from the results listed in table 3, that the inventive guanidine compounds as additives in an aqueous acidic copper plating bath show superior copper pillar formation compared to the urea polymers which were known in the prior art. The urea polymer gave smaller pillar bumps compared to any of the inventive guanidine compounds, which already indicates inferior uniformity with regards to the overall coupon. Moreover, the urea polymer exhibits pronounced nodule formation on the corner dies. Only one of the inventive guanidine compound, namely GC4 caused nodules which were significantly less pronounced compared to those obtained from the urea polymer. Pillars formed with the urea polymers are thus less homogeneous in height and less uniformly shaped as compared to pillars formed with the inventive guanidine compounds. These are important prerequisites for today's manufacturing of printed circuit board, IC substrates and the like.

Other embodiments of the present invention will be apparent to those skilled in the art from a consideration of this specification or practice of the invention disclosed herein. It is intended that the specification and examples be considered as exemplary only, with the true scope of the invention being defined by the following claims only.

The invention claimed is:

1. An aqueous acidic copper plating bath for deposition of copper or copper alloys comprising at least one source of copper ions, at least one acid, and at least one guanidine compound which contains at least one unit according to formula (I)

$$\text{-A-D-}_a \qquad \text{(I)}$$

wherein a is an integer ranging from 1 to 40 and A represents a unit derived from a monomer according to the following formulae (A1) and/or (A2)

(A1)

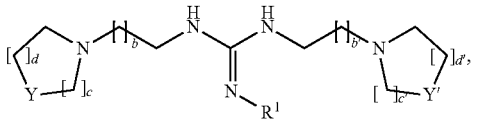

(A2)

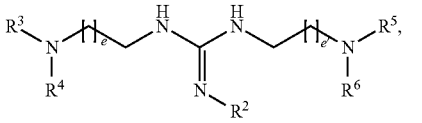

wherein

Y and Y' are each individually selected from the group consisting of $CH_2$, O and S;

$R^1$ is an organic residue selected from the group consisting of hydrogen, alkyl, aryl and alkaryl;

$R^2$ is an organic residue selected from the group consisting of hydrogen, alkyl, aryl and alkaryl;

$R^3$, $R^4$, $R^5$ and $R^6$ are each organic residues independently from each other selected from the group consisting of hydrogen, alkyl, aryl and alkaryl;

b and b' are integers each individually and independently from each other ranging from 0 to 6;

c and c' are integers each individually and independently from each other ranging from 1 to 6;

d and d' are integers each individually and independently from each other ranging from 0 to 6;

e and e' are integers each individually and independently from each other ranging from 0 to 6;

D is a divalent residue and is selected from the group consisting of $—Z^1—[Z^2—O]_g—Z^3—$, $—[Z^4—O]_h—Z^5—$, and $—CH_2—CH(OH)—Z^6—[Z^7—O]_i—Z^8—CH(OH)—CH_2—$;

wherein $Z^1$ is an alkylene group with 1 to 6 carbon atoms;

$Z^2$ is selected from the group consisting of alkylene group with 1 to 6 carbon atoms, aryl-substituted alkylene groups whereby the alkylene group comprises 1 to 6 carbon atoms and mixtures of the aforementioned;

$Z^3$ is an alkylene group with 1 to 3 carbon atoms;

$Z^4$ is selected from the group consisting of alkylene group with 1 to 6 carbon atoms, aryl-substituted alkylene groups whereby the alkylene group comprises 1 to 6 carbon atoms and mixtures of the aforementioned;

$Z^5$ is an alkylene group with 1 to 3 carbon atoms;

$Z^6$ is an alkylene group with 1 to 6 carbon atoms;

$Z^7$ is selected from the group consisting of alkylene group with 1 to 6 carbon atoms, aryl-substituted alkylene groups whereby the alkylene group comprises 1 to 6 carbon atoms and mixtures of the aforementioned;

$Z^8$ is an alkylene group with 1 to 3 carbon atoms;

g is an integer ranging from 1 to 100;

h is an integer ranging from 1 to 100;

i is an integer ranging from 1 to 100; and wherein the individual units A are selected independently from each other, and the individual units D are selected independently from each other and the guanidine compound is linear and/or cross-linked, and wherein the bath is free of intentionally added zinc ions.

2. The aqueous acidic copper plating bath according to claim 1 characterised in that the guanidine compound comprises one or more units according to formula (I) and one or more of terminating groups $P^1$ and/or one or more of terminating groups $P^2$ whereby terminating groups $P^1$ are bound to a unit A derived from monomers according to formulae (A1) and/or (A2) and terminating groups $P^2$ are bound to divalent residues D, respectively, in the unit according to formula (I) and wherein the terminating groups $P^1$ are selected from the group consisting of

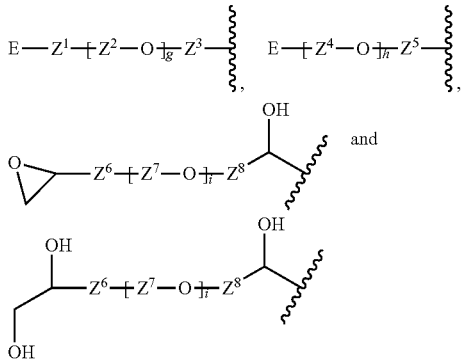

wherein the individual groups $Z^1$ to $Z^8$ as well as g to i are selected from above-defined groups and E is a leaving group and selected from the group consisting of triflate, nonaflate, alkylsulphonate, arylsulphonate and halogenides and wherein the terminating group $P^2$ is selected from the group consisting of hydroxyl group (—OH), a unit derived from monomers according to formulae (A1) and/or (A2), leaving group E,

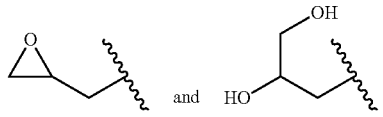

wherein the individual groups E and monomers according to formulae (A1) and/or (A2) are selected from above-defined groups.

3. The aqueous acidic copper plating bath according to claim 2 characterised in that the guanidine compound consists of a unit according to formula (I) and terminating groups $P^1$ and/or $P^2$.

4. The aqueous acidic copper plating bath according to claim 3 characterised in that $Z^2$ is selected from the group consisting of ethane-1,2-diyl, propane-1,3-diyl, propane-1,2-diyl, butane-1,2-diyl, 1-phenylethane-1,2-diyl and mixtures of the aforementioned; or $Z^4$ is selected from the group consisting of ethane-1,2-diyl, propane-1,3-diyl, propane-1,2-diyl, butane-1,2-diyl, 1-phenylethane-1,2-diyl and mixtures of the aforementioned; or $Z^7$ is selected from the group consisting of ethane-1,2-diyl, propane-1,3-diyl, propane-1,2-diyl, butane-1,2-diyl, 1-phenylethane-1,2-diyl and mixtures of the aforementioned.

5. The aqueous acidic copper plating bath according to claim 4 characterised in that D is selected from —$Z^1$—[$Z^2$—O]$_g$—$Z^3$— and —[$Z^4$—O]$_h$—$Z^5$—.

6. The aqueous acidic copper plating bath according to claim 2 characterised in that $Z^2$ is selected from the group consisting of ethane-1,2-diyl, propane-1,3-diyl, propane-1,2-diyl, butane-1,2-diyl, 1-phenylethane-1,2-diyl and mixtures of the aforementioned; or $Z^4$ is selected from the group consisting of ethane-1,2-diyl, propane-1,3-diyl, propane-1,2-diyl, butane-1,2-diyl, 1-phenylethane-1,2-diyl and mixtures of the aforementioned; or $Z^7$ is selected from the group consisting of ethane-1,2-diyl, propane-1,3-diyl, propane-1,2-diyl, butane-1,2-diyl, 1-phenylethane-1,2-diyl and mixtures of the aforementioned.

7. The aqueous acidic copper plating bath according to claim 1 characterised in that the guanidine compound consists of a unit according to formula (I) and terminating groups $P^1$ and/or $P^2$.

8. The aqueous acidic copper plating bath according to claim 7 characterised in that:

$Z^2$ is selected from the group consisting of ethane-1,2-diyl, propane-1,3-diyl, propane-1,2-diyl, butane-1,2-diyl, 1-phenylethane-1,2-diyl and mixtures of the aforementioned; or $Z^4$ is selected from the group consisting of ethane-1,2-diyl, propane-1,3-diyl, propane-1,2-diyl, butane-1,2-diyl, 1-phenylethane-1,2-diyl and mixtures of the aforementioned; or $Z^7$ is selected from the group consisting of ethane-1,2-diyl, propane-1,3-diyl, propane-1,2-diyl, butane-1,2-diyl, 1-phenylethane-1,2-diyl and mixtures of the aforementioned.

9. The aqueous acidic copper plating bath according to claim 1 characterised in that $Z^2$ is selected from the group consisting of ethane-1,2-diyl, propane-1,3-diyl, propane-1,2-diyl, butane-1,2-diyl, 1-phenylethane-1,2-diyl and mixtures of the aforementioned; or $Z^4$ is selected from the group consisting of ethane-1,2-diyl, propane-1,3-diyl, propane-1,2-diyl, butane-1,2-diyl, 1-phenylethane-1,2-diyl and mixtures of the aforementioned; or $Z^7$ is selected from the group consisting of ethane-1,2-diyl, propane-1,3-diyl, propane-1,2-diyl, butane-1,2-diyl, 1-phenylethane-1,2-diyl and mixtures of the aforementioned.

10. The aqueous acidic copper plating bath according to claim 1 characterised in that $Z^1$ is an alkylene group with 2 to 3 carbon atoms;

$Z^3$ is an alkylene group with 2 to 3 carbon atoms;

$Z^5$ is an alkylene group with 2 to 3 carbon atoms;

$Z^6$ is an alkylene group with 2 to 3 carbon atoms;

g is an integer ranging from 1 to 20;

h is an integer ranging from 1 to 20; or i is an integer ranging from 1 to 20.

11. The aqueous acidic copper plating bath according to claim 1 characterised in that D is selected from —$Z^1$—[$Z^2$—O]$_g$—$Z^3$— and —[$Z^4$—O]$_h$—$Z^5$—.

12. The aqueous acidic copper plating bath according to claim 1 characterised in that a is an integer ranging from 2 to 30 b, b', e and e' are integers each individually and independently from each other ranging from 1 to 2, c and c' are integers each individually and independently from each other ranging from 1 to 3;

d and d' are integers each individually ranging from 0 to 3, c, c', d and d' are selected with the proviso that the sum of c+d and c'+d' each ranges from 2 to 5.

13. The aqueous acidic copper plating bath according to claim 1 characterised in that the guanidine compounds have a weight average molecular mass $M_W$ of 500 to 50000 Da.

14. The aqueous acidic copper plating bath according to claim 13 characterised in that the guanidine compounds have a weight average molecular mass $M_W$ of 1100 to 3000 Da.

15. The aqueous acidic copper plating bath according to claim 1 characterised in that the concentration of the at least one guanidine compound in the aqueous acidic copper plating bath ranges from 0.01 mg/l to 1000 mg/l.

16. The aqueous acidic copper plating bath according to claim 1 characterised in that the concentration of the at least one guanidine compound in the aqueous acidic copper plating bath ranges from 0.1 mg/l to 100 mg/l.

17. The aqueous acidic copper plating bath according to claim 1 characterised in that the aqueous acidic copper plating bath comprises at least one further source of reducible metal ions selected from the group consisting of sources of gold ions, sources of tin ions, sources of silver ions, and sources of palladium ions.

18. The aqueous acidic copper plating bath according to claim 17 characterised in that the total amount of further sources of reducible metal ions is comprised in an amount of up to 50 wt.-% in relation to the amount of copper ions.

19. The aqueous acidic copper plating bath according to claim 1 characterised in that the aqueous acidic copper plating bath comprises no intentionally added further source of reducible metal ions.

20. A method for deposition of copper or copper alloy onto a substrate comprising, in this order, the steps a. providing a substrate, b. contacting the substrate with the aqueous acidic copper plating bath according to claim 1, and c. applying an electrical current between the substrate and at least one anode, for a time sufficient to deposit copper or copper alloy on at least a portion of the surface of a substrate.

* * * * *